US008731415B2

(12) United States Patent
Hogan et al.

(10) Patent No.: US 8,731,415 B2
(45) Date of Patent: May 20, 2014

(54) CAPACITIVE SENSOR FOR SENSING STATE OF WASTE TONER BOX IN AN IMAGING APPARATUS

(75) Inventors: Andrew Charles Hogan, Lexington, KY (US); Peyman Kermanshahi Nejad, Lexington, KY (US); James Marion Nimmo, Georgetown, KY (US); David Anthony Schneider, Lexington, KY (US); Christopher Kent Washing, Lexington, KY (US)

(73) Assignee: Lexmark International, Inc. KY (US)

( * ) Notice: Subject to any disclaimer, the term of this patent is extended or adjusted under 35 U.S.C. 154(b) by 960 days.

(21) Appl. No.: 12/618,220

(22) Filed: Nov. 13, 2009

(65) Prior Publication Data

US 2010/0303484 A1 Dec. 2, 2010

Related U.S. Application Data

(60) Provisional application No. 61/182,562, filed on May 29, 2009.

(51) Int. Cl.
*G03G 15/01* (2006.01)
*G03G 21/00* (2006.01)

(52) U.S. Cl.
USPC ..... 399/35; 399/358

(58) Field of Classification Search
USPC ..... 399/35, 358
See application file for complete search history.

(56) References Cited

U.S. PATENT DOCUMENTS

| | | | | |
|---|---|---|---|---|
| 2001/0004423 | A1 * | 6/2001 | Kakeshita et al. | 399/24 |
| 2006/0193649 | A1 * | 8/2006 | Soutome | 399/27 |
| 2006/0269305 | A1 * | 11/2006 | Murakami et al. | 399/35 |
| 2008/0069576 | A1 * | 3/2008 | Etter et al. | 399/35 |

* cited by examiner

*Primary Examiner* — David Gray
*Assistant Examiner* — Erika J Villaluna

(57) ABSTRACT

A capacitive sensor for sensing amount of waste toner in a waste toner box of an imaging apparatus includes a capacitor that has a pair of separated plates disposed within the interior of the waste toner box. The capacitance of the capacitor changes with the amount of toner in between the plates of the capacitor. A sensor circuitry is connected to the plates of the waste toner box that measure the capacitance of the capacitor as a voltage value. This voltage value is provided to a controller that determines a relative change in the capacitance value by determining a change in capacitance of the capacitor with respect to a number of pages printed by the imaging apparatus. The controller then determines the state of the waste toner box based on this relative change in capacitance.

18 Claims, 15 Drawing Sheets

CAPACITIVE SENSOR FOR SENSING STATE OF WASTE TONER BOX IN AN IMAGING APPARATUS

CROSS REFERENCE TO RELATED APPLICATIONS

This patent application is related to and claims benefit from U.S. Patent Application Ser. No. 61/182,562, filed May 29, 2009, entitled "Improved Algorithm for a Capacitance Sensor in an Electrophotographic Printer" and assigned to the assignee of the present application, the content of which is hereby incorporated by reference herein in its entirety.

BACKGROUND

1. Field of the Invention

The present invention relates generally to an image forming apparatus, and more particularly to a capacitive sensor that determines amounts of waste toner in a waste toner box.

2. Description of the Related Art

Color Electro Photographic (EP) printers typically include four image forming units that transfer toner either to an intermediate transport module or directly to a sheet that is transported under the image forming units on a transfer member. In either case the EP process generates waste toner that needs to be cleaned off photoconductive members of the image forming units and the transfer member. Some systems have a central waste toner box that collects the waste toner from the photoconductive members and the transfer member. When the waste toner box fills to its maximum capacity, the waste may backup into the image forming units and damage the imaging apparatus. Therefore, a sensor is required to detect levels of waste toner in the waste toner box.

Prior systems have used a torque sensor to measure back pressure on a toner-moving auger, or an optical sensor to detect when the waste toner box is full. However, both the torque and the optical sensor have their problems. While, the torque sensor requires that the waste toner be packed into the waste toner box, the optical sensor requires a wiper to keep the optical path clear of stray toner.

Another sensor used in the prior system is a capacitive sensor that has a capacitor, the capacitance of the capacitor changes as the medium between plates of the capacitor changes from air to waste toner. The system that uses a capacitance sensor requires that the capacitor be calibrated at the factory and the initial calibration value to be saved in a non-volatile memory. The imaging apparatus then determines a delta change in capacitance value to determine the amount of toner within the waste toner box. If non-volatile memory is not available, then the capacitive sensor has to depend on either absolute value or monitor the relative change in capacitance to determine when the waste toner box is full. However, because of the large tolerance in the absolute value of the capacitance, the size of plates of the capacitor, and the distance between the plates, using absolute values can greatly decrease the expected yield of the waste toner box.

Therefore, it would be desirable to have a capacitive sensor that eliminates the need to store the initial value of the capacitance sensor, in a non-volatile memory while maximizing the capacity of the waste toner box.

SUMMARY OF THE INVENTION

Disclosed herein is a method for determining a relative amount of waste toner in a waste toner box of an imaging apparatus including measuring a voltage at a beginning and an end of a plurality of intervals, the measured voltage corresponding to a capacitance within the waste toner box that varies with an amount of waste toner in between the pair of separated plates, determining a relative change in capacitance based on the voltage measured, the relative change in capacitance being determined by: calculating a difference between the voltage measured at the beginning and the end of each of the plurality of intervals, and dividing each voltage difference by a divisor value to determine the relative change in capacitance, comparing the determined relative change in capacitance with a predetermined threshold value, the predetermined threshold value being the predetermined minimum value for the relative change in capacitance, and determining the relative amount of waste toner in the waste toner box based on the comparison.

In some embodiments, the relative amount of waste toner in the waste toner box is determined as nearly full when the relative change in capacitance is less than the predetermined threshold value.

In some embodiments, the method further includes counting a number of pages printed by the imaging apparatus, setting a near full page count variable to the count of the number of pages printed when the relative amount of waste toner in the waste toner box is determined as being nearly full, comparing the count of the number of pages printed by the imaging apparatus with a sum of the near full page count variable and a predetermined full page delta value, and determining the relative amount of waste toner in the waste toner box as full when the count of the number of pages is greater than the sum of the near full page count variable and the predetermined full page delta value.

In another aspect, a method for determining an amount of waste toner in a waste toner box of an imaging apparatus is disclosed, the method including: measuring a voltage within the waste toner box, the voltage corresponding to a capacitance that varies with an amount of toner in the waste toner box between a pair of separated plates, comparing the measured voltage with at least one of an empirically determined value corresponding to a new waste toner box, an intermediate toner level in the waste toner box, and a full toner level in the waste toner box, and determining the amount of waste toner in the waste toner box based on the comparison.

In yet another aspect, an imaging apparatus is disclosed that includes a waste toner box that includes an inlet port for collecting waste toner, a pair of separated plates positioned within the waste toner box to form a capacitor, the capacitor having a capacitance that varies in correspondence with an amount of waste toner in between the separated plates, sensor circuitry in electrical communication with the capacitor for measuring a voltage at a beginning and an end of a plurality of intervals, the voltage value being indicative of a capacitance of the capacitor, and a controller in electrical communication with the sensor circuitry, the controller determining the amount of waste toner in the waste toner box by: determining a relative change in capacitance based on the voltage measured, the relative change in capacitance being determined by calculating a difference between the voltage measured at the beginning and the end of each of the plurality of intervals and dividing the difference by a predetermined number to determine the relative change in capacitance, the predetermined number being the number of pages printed during the plurality of intervals, comparing the determined relative change in capacitance with a predetermined threshold value, the predetermined threshold value being the predetermined minimum value for the relative change in capacitance, and determining the relative amount of waste toner in the waste toner box based on the comparison.

Additional features and advantages of the invention will be set forth in the detailed description which follows, and in part will be readily apparent to those skilled in the art from that description or recognized by practicing the invention as described herein, including the detailed description which follows, the claims, as well as the appended drawings.

It is to be understood that both the foregoing general description and the following detailed description of the present embodiments of the invention are intended to provide an overview or framework for understanding the nature and character of the invention as it is claimed. The accompanying drawings are included to provide a further understanding of the invention and are incorporated into and constitute a part of this specification. The drawings illustrate various embodiments of the invention and together with the description serve to explain the principles and operation of the invention.

BRIEF DESCRIPTION OF THE DRAWINGS

The above-mentioned and other features and advantages of the various embodiments of the invention, and the manner of attaining them, will become more apparent will be better understood by reference to the accompanying drawings, wherein.

DETAILED DESCRIPTION

Figure 1:
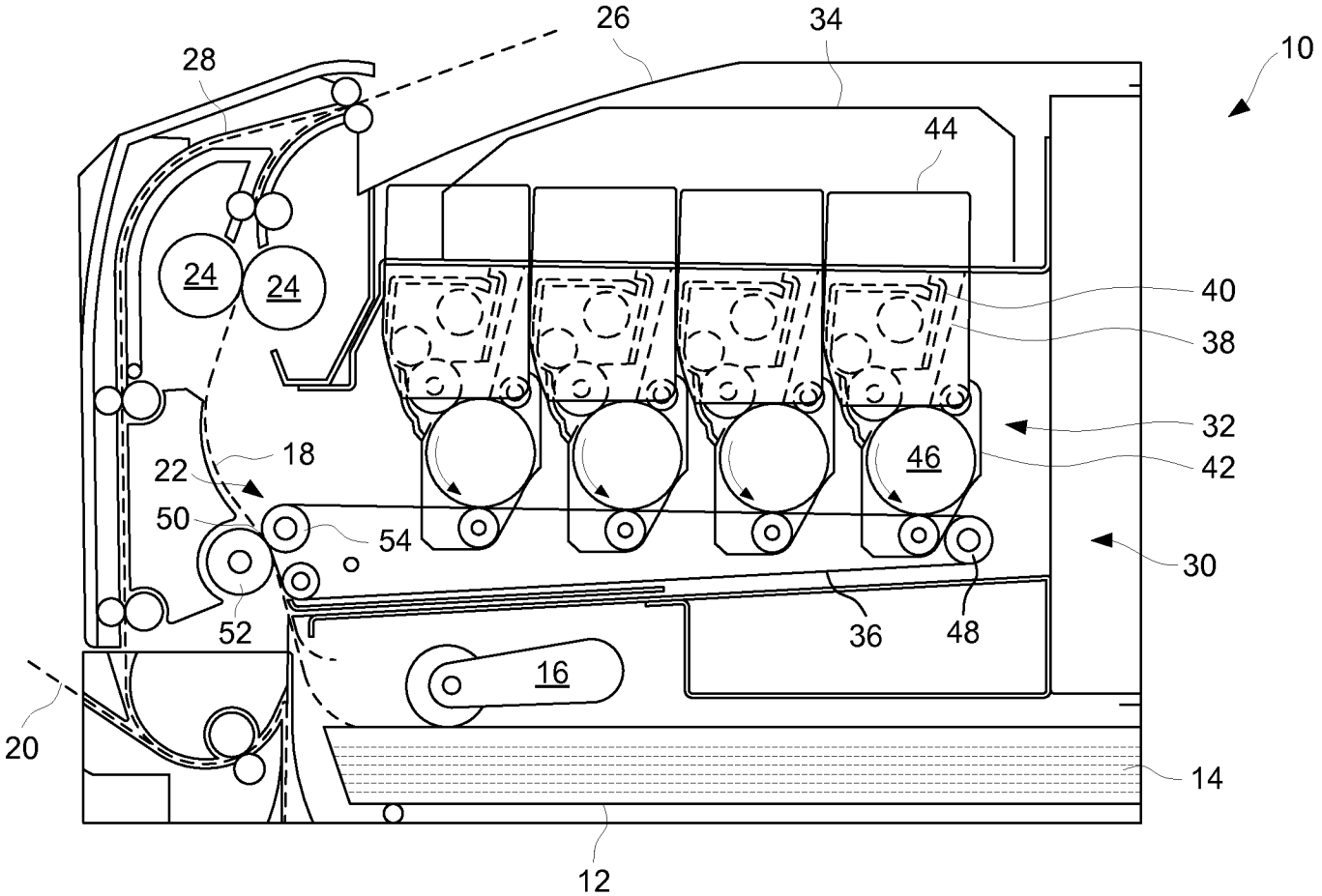
FIG. 1 is a schematic view illustrating an imaging apparatus, according to one embodiment of the present invention.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

Reference will now be made in detail to the exemplary embodiment(s) of the invention, as illustrated in the accompanying drawings. Whenever possible, the same reference numerals will be used throughout the drawings to refer to the same or like parts.

One embodiment of an imaging apparatus 10 according to the present invention is illustrated in FIG. 1. Imaging apparatus 10 includes an input tray 12 sized to contain a stack of media sheets 14. A pick mechanism 16 is positioned adjacent the input tray 12 for moving a top-most sheet from the stack 14 and into a media path 18. Alternatively, the media sheets 14 may move into the media path 18 via a manual feed 20. The media sheets 14 move from the input tray 12 along the media path 18 to a transfer area 22. The media sheet 14 receives one or more toner images at the transfer area 22. The media sheet 14 with the toner images next moves through a fuser 24 to adhere the toner images to the media sheet 14. The media sheet 14 is then either discharged into an output tray 26 or moved into a duplex path 28 for forming a toner image on a second side of the media sheet 14.

An image formation area 30, of the imaging apparatus 10, includes an imaging unit 32, a laser printhead 34, and a transfer member 36. Imaging unit 32 includes one or more imaging stations 38 that each includes a developer unit 40, a photoconductor unit 42, and a toner cartridge 44. For clarity, the units 40, 42, and cartridge 44 are labeled on only one of the imaging stations 38 in FIG. 1. In one embodiment, imaging apparatus 10 is a monochromatic imaging apparatus including a single imaging station 38 for forming toner images in a single color. In another embodiment, the imaging unit 32 includes multiple separate imaging stations 38, each being substantially the same except for the color of the toner. In one embodiment, the imaging unit 32 includes four imaging stations 38, each of the imaging station 38 contains the toner cartridge 44 having one of black, magenta, cyan, or yellow toner.

Laser printhead 34 includes a laser that discharges a surface of photoconductive (PC) members 46 within each of the imaging stations 38. Toner from a developer unit 40 in the imaging station 38 attracts to the surface area of the PC members 46 discharged by the laser printhead 34.

The transfer member 36 extends continuously around a series of rollers 48. Transfer member 36 receives the toner images from each of the PC members 46. In one embodiment, the toner images from each of the PC members 46 are placed onto transfer member 36 in an overlapping arrangement. In one embodiment, a multi-color toner image is formed during a single pass of the transfer member 36. By way of example, the yellow toner may be placed first on the transfer member 36, followed by cyan, magenta, and black. After receiving the toner images, transfer member 36 moves the images to the transfer area 22 where the toner images are transferred to the media sheet 14. The transfer area 22 includes a nip 50 formed by a transfer roller 52 and the back up roller 54. The media sheet 14 moves along the media path 18 through the nip 50 to receive the toner images from the transfer member 36. The media sheet 14 with the toner images next moves through the fuser 24 and is then discharged at the output tray 26 or moved into the duplex path 28.

The imaging apparatus 10 maintains a count of the number of sheets (Machine_Page_Count) printed by the imaging apparatus 10, which is stored in a memory (not shown) of the imaging apparatus 10.

During the formation of toner images by the imaging apparatus 10, waste toner is generated that needs to be cleaned off the respective PC members 46 and the transfer member 36. This waste toner is then dumped into a waste toner box 56 (FIG. 2) that needs to be replaced periodically.

Figure 2:
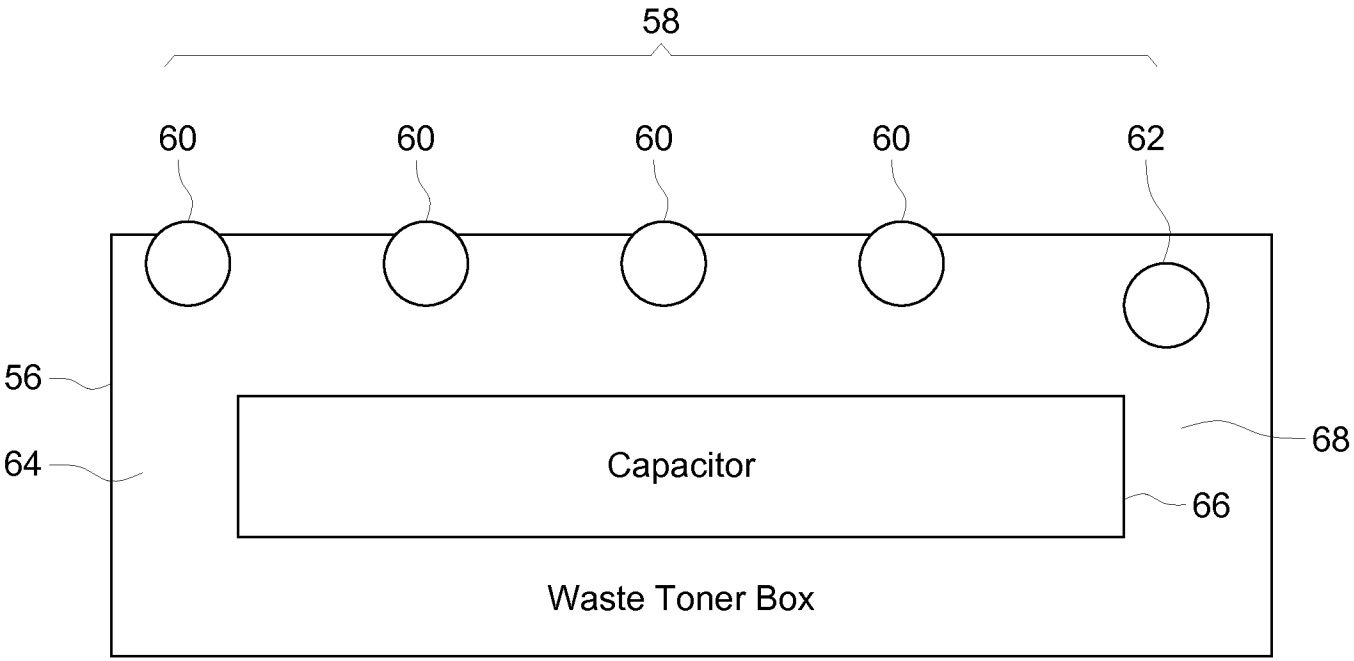
FIG. 2 illustrates a schematic view of a waste toner box, according to one embodiment of the present invention.

FIG. 2 illustrates a schematic view of the waste toner box 56 according to one embodiment of the present invention. The waste toner box 56 includes a plurality of inlet ports 58 for receiving the waste toner from the PC members 46 and the transfer member 36. In one embodiment, the waste toner box 56 may include separate inlet port 60 for the PC members 46 and separate inlet port 62 for the transfer member 36. The waste toner box 56 defines an internal volume 64 for collecting the waste toner. A capacitor 66 is positioned within the waste toner box 56, preferably in a middle portion 68 of the waste toner box 56, for measuring the amount of waste toner within the waste toner box 56.

Figure 3:
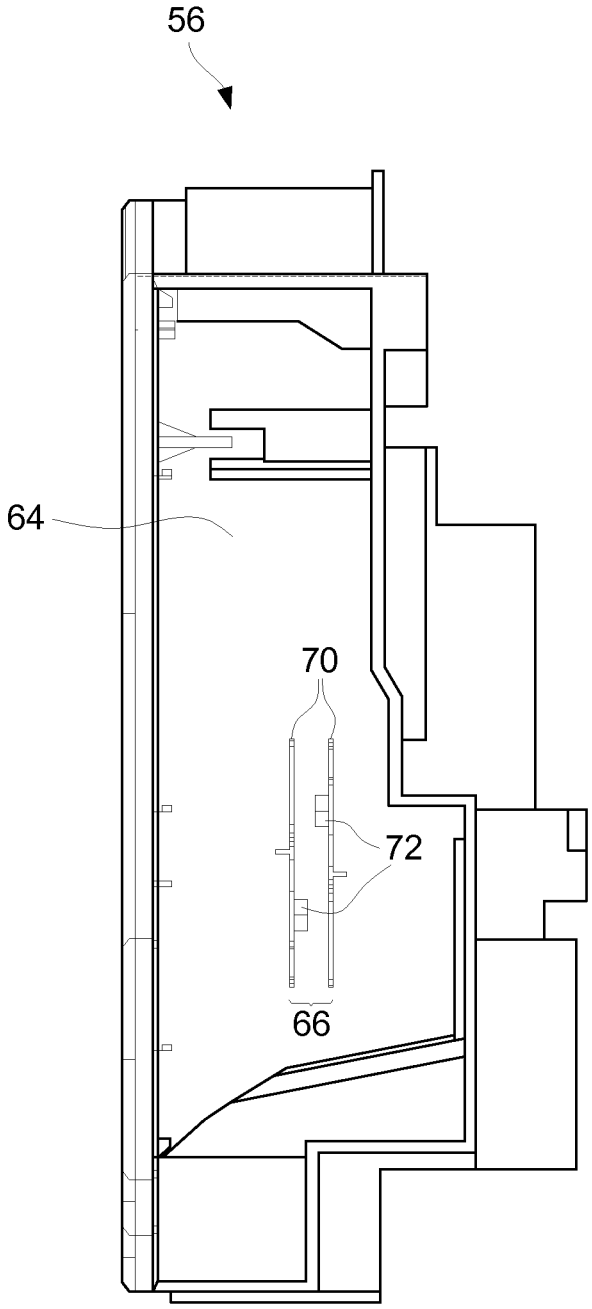
FIG. 3 illustrates a schematic view of the waste toner box including plates of a capacitor present within the waste toner box, according to one embodiment of the present invention.

FIG. 3 illustrates a schematic view of the waste toner box 56 including the capacitor 66, according to one embodiment of the present invention. The capacitor 66 includes a pair of separated plates 70 that are parallel to each other. The plates 70 may be oriented vertically so that as the waste toner accumulates within the interior volume 64 of the waste toner box 56, the waste toner will fill the space between the plates 70. The plates 70 of the capacitor 66 may be secured within the waste toner using bolts 72. The capacitance of the capacitor 66 changes in correspondence with the amount of toner in between the plates 70 of the capacitor 66.

Figure 4:
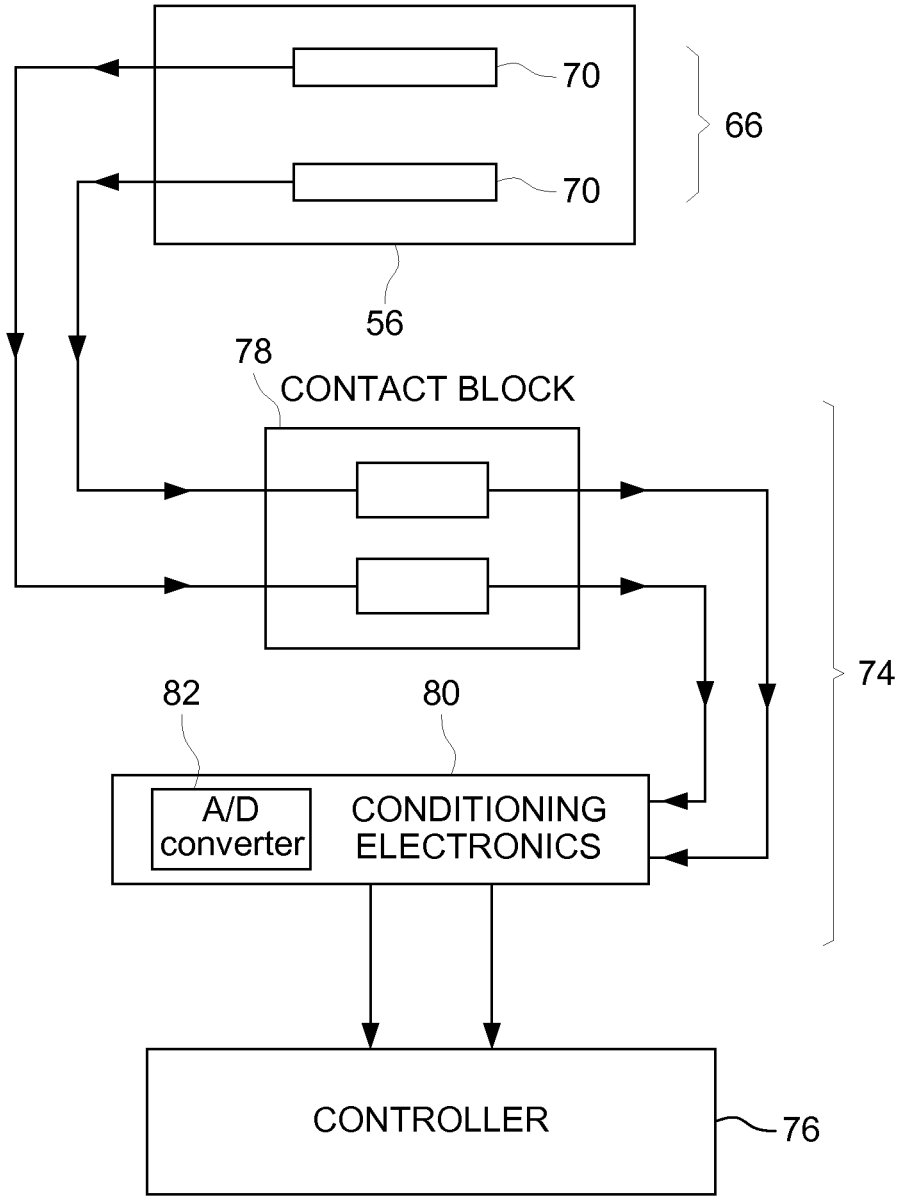
FIG. 4 illustrates a schematic view of the capacitor present within the waste toner box connected to a sensor circuitry and a controller, according to one embodiment of the present invention.

FIG. 4 illustrates a schematic view of the capacitor 66 present within the waste toner box 56 connected to sensor circuitry 74 and a controller 76, according to one embodiment of the present invention. As shown, the plates 70 of the capacitor 66 are connected to a contact block 78 of the sensor circuitry 74 that provides electrical connection between the plates 70 and conditioning electronics 80 of the sensor circuitry 74. The capacitor 66 and the conditioning electronics 80 together form a resonance circuit. An AC voltage is applied to the resonance circuit for measuring an output AC voltage that changes linearly with the change in the capacitance of the capacitor 66.

The output AC voltage is provided to an Analog to Digital (A/D) converter 82 that converts the output AC voltage to an output digital voltage value of the waste toner box 56 (AVG_WTB_AD). The sensor circuitry 74 measures the output digital voltage value at a beginning and end of a plurality of intervals. In one embodiment, a predetermined number, such as 500, of pages are printed during each of the plurality of intervals. However, the interval may have fewer or more number of pages printed.

The controller 76 that is in electrical communication with the sensor circuitry 74 obtains this digital output voltage value. The memory of the imaging apparatus 10 provides the Machine_Page_Count to the controller 76. The controller 76 determines an amount of waste toner within the waste toner box 56 based on the relative change in capacitance (measured as a voltage value, AVG_WTB_AD) of the capacitor 66 with respect to the Machine_Page_Count. It is understood that controller 76 may be implemented in a number of ways, such as a state machine in an integrated circuit or a processor which executes firmware instructions stored in memory associated with controller 76.

Figure 5:
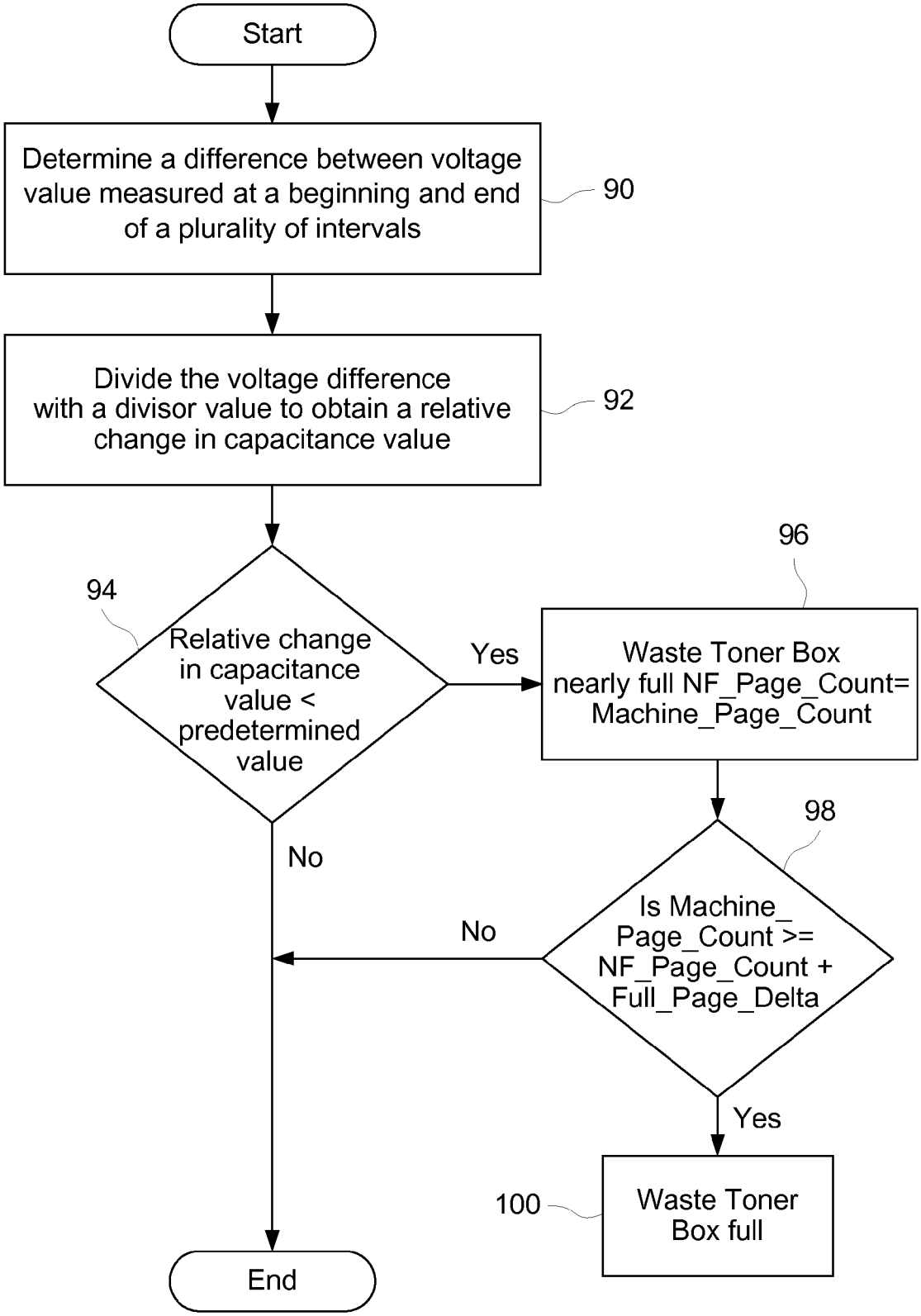
FIG. 5 illustrates the processing actions performed by the controller to measure the amount of toner within the waste toner box, according to one embodiment of the present invention.

FIG. 5 illustrates the processing actions performed by the controller 76 to measure the amount of toner within the waste toner box 56, according to one embodiment of the present invention. Initially, at act 90 the controller 76 calculates a difference between voltage values measured at the beginning and end of each of the plurality of intervals by sensor circuitry 74. A predetermined number of pages may be printed between each of the plurality of intervals. Next, at act 92 the controller 76 divides each voltage difference value by a divisor value to obtain a relative change in capacitance value. The divisor value may be a predetermined number of pages printed by the imaging apparatus 10. In one embodiment, the predetermined number of pages is 500. The determined relative change in capacitance value is then compared with a predetermined slope threshold value (act 94). In the event the relative change in capacitance value is less than the predetermined threshold value, the amount of toner within the waste toner box 56 is determined to be nearly full and a near full page count (NF_Page_Count) variable is set to the Machine_Page_Count (act 96).

Next, at act 98 the controller 72 determines whether the imaging apparatus 10 has printed a predetermined full page delta (FULL_PAGES_DELTA), which represents a predetermined number of pages printed from the time the waste toner box 56 is identified as nearly full to the time waste toner box 56 is identified as full. In case the condition in act 98 is true, the amount of toner in the waste toner box 56 is determined to be full (act 100). In one embodiment the FULL_PAGES_DELTA value is 2000.

Figure 6:
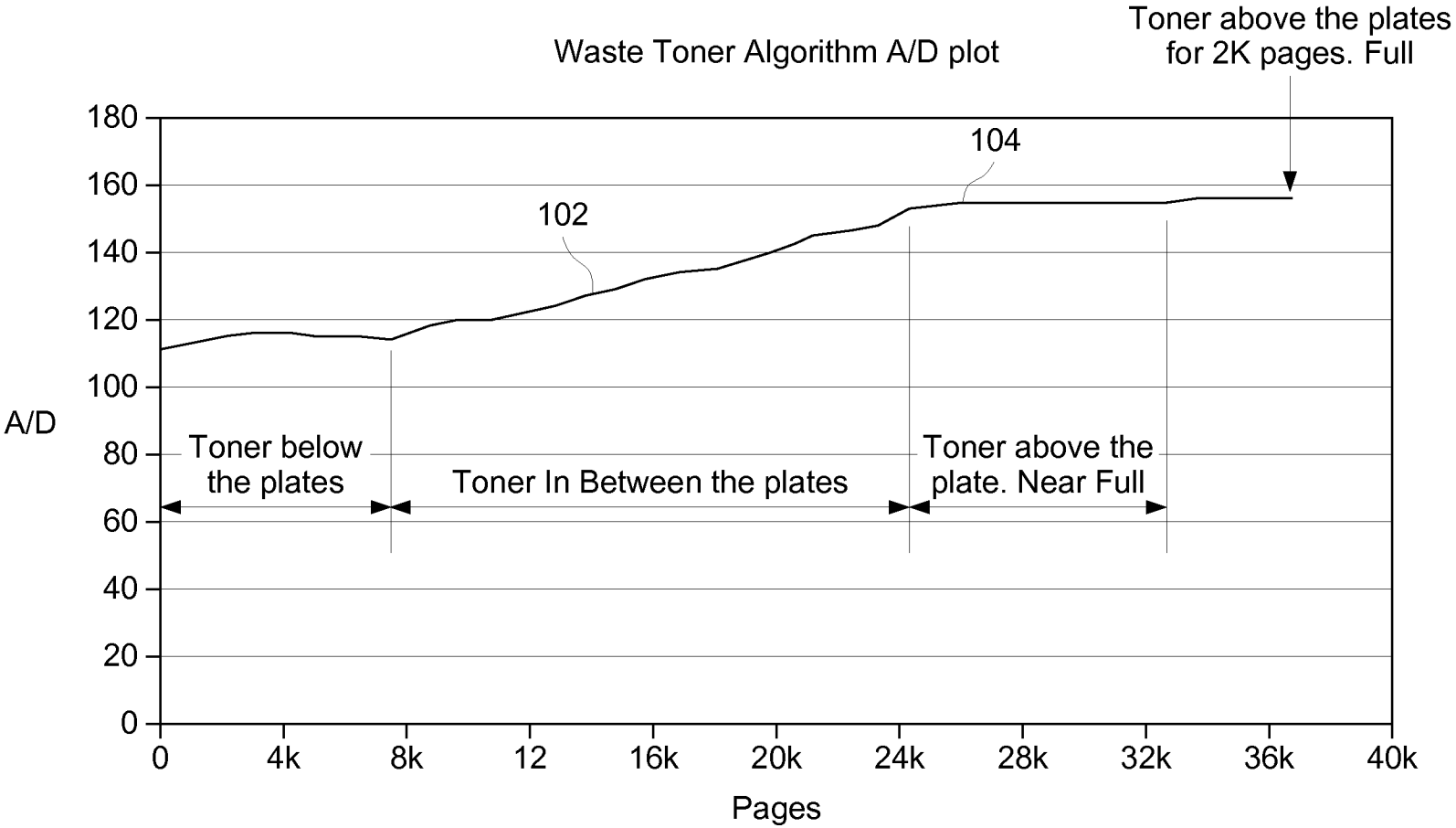
FIG. 6 illustrates graphically the relative change in capacitance with respect to the number of pages printed by the imaging apparatus, according to one embodiment of the present invention.

FIG. 6 illustrates graphically the relative change in capacitance (measured as the digital output voltage value, AVG_WTB_AD) with respect to the number of pages printed by the imaging apparatus 10. The graph 102 shows the four conditions of the waste toner box 56 based on the amount of waste toner within the waste toner box 56, i.e., toner below the plates 70 of the capacitor 66, toner in between the plates 70 of the capacitor 66, toner above the plates 70 of the capacitor 66, where the waste toner box is determined to be nearly full, and toner above the plates 70 of the capacitor 66 for 2000 pages after the waste toner box is determined as nearly full, where the waste toner box is determined to be full. In one embodiment, after the controller 76 has determined that the waste box 56 is new, the sensor circuitry 74 starts sensing the capacitance value after a predetermined number of voltage readings (AD_Slope1) to allow the waste toner to build up and reach the capacitance plates 66. In one embodiment, the AD_Slope1 value is 16. As shown, the slope of the graph 102 is roughly the same for the toner below the plates 70 of the capacitor 66 and the toner above the plates 70 of the capacitor 66. Delaying the sensing of the capacitance for AD_Slope1 number of voltage readings ensures that the controller 72 would start determining toner level when the amount of toner is in between the plates 70 of the capacitor 66.

When the toner is above the plates 70 (represented by point 104) of the capacitor 66, the graph 102 flattens, i.e., the relative change in capacitance with respect to the number of pages printed by the imaging apparatus 10 approaches zero. When this occurs, the waste toner box 56 is determined to be nearly full. After the waste toner box 56 is determined to be nearly full at point 104, the imaging apparatus 10 prints a predetermined (Full_Pages_Delta) number of pages, after which the waste toner box 56 is determined as full. Determining the amount of toner within the waste toner box 56 based on the relative change in the capacitance ensures that the controller 72 can determine the amount of toner within the waste toner box 56 even when the toner is above the plates 70 of the capacitor 66. Determining the amount of toner within the waste toner box 56 based on the relative change in the capacitance also ensures that the calibration value of the capacitor 66 is not required to determine the amount of waste toner in the waste toner box 56, as in prior systems.

Figure 7:
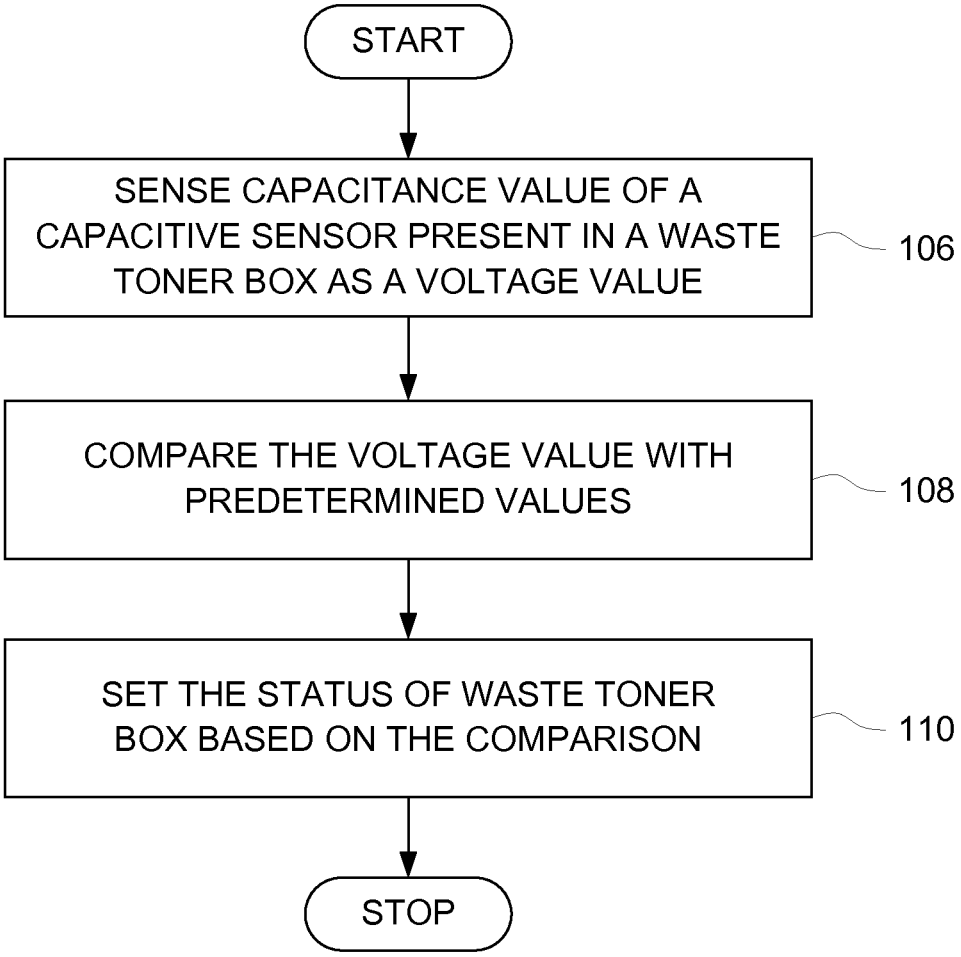
FIG. 7 illustrates the controller determining the amount of waste toner in the waste toner box during a depot service, according to one embodiment of the present invention.

FIG. 7 illustrates the controller 76 determining the amount of waste toner in the waste toner box 56 during a depot service activity, according to one embodiment of the present invention. A depot service is a service that may be provided by the manufacturer or retailer of imaging apparatus 10 that is responsive to a case of failure of the imaging apparatus 10. The manufacturer/retailer provides to a customer a shell (not illustrated) of the imaging apparatus 10 with an empty waste toner box. The shell may include most of the working components and modules of a new imaging apparatus less, for example, some or all of imaging stations 38 which may be transferred from the failing imaging apparatus to the shell to create a new imaging apparatus 10. The new imaging station 10 resets the status of the waste toner box 56 stored in memory to factory default values such that the new imaging apparatus 10 would be expecting an empty waste toner box. However, the user might prefer to reuse the original waste toner box 56 from the failing imaging apparatus 10 if such original waste toner box 56 is not full with toner. Since the status of waste toner box 56 of the new imaging apparatus 10 is reset in memory to factory default values, the controller 76 therein would not be able to correctly detect the amount of toner in the reused waste toner box 56, potentially causing the reused waste toner box 56 to eventually overflow, thus damaging the imaging apparatus 10. To overcome this problem, the memory of the new imaging apparatus 10 stores a plurality of predetermined voltage values corresponding to an empty waste toner box, a near full waste toner box, a full waste toner box, and a waste toner box missing from the imaging apparatus 10 for use in identifying toner level in the waste toner box 56 immediately following depot service activity.

Initially, at act 106 when the waste toner box 56 is inserted in the (new) imaging apparatus 10, the voltage value corresponding to the capacitance of the capacitor 66 is determined. Next, at act 108 the voltage value is compared with the stored predetermined values corresponding to the empty waste toner box 56, the near full waste toner box 56, the full waste toner box 56, and the waste toner box 56 missing from the imaging apparatus 10. Based on the comparisons and upon other variables and settings maintained prior to imaging apparatus 10 failing, the status of the waste toner box 56 within the imaging apparatus 10 is appropriately set (act 110).

Figure 8:
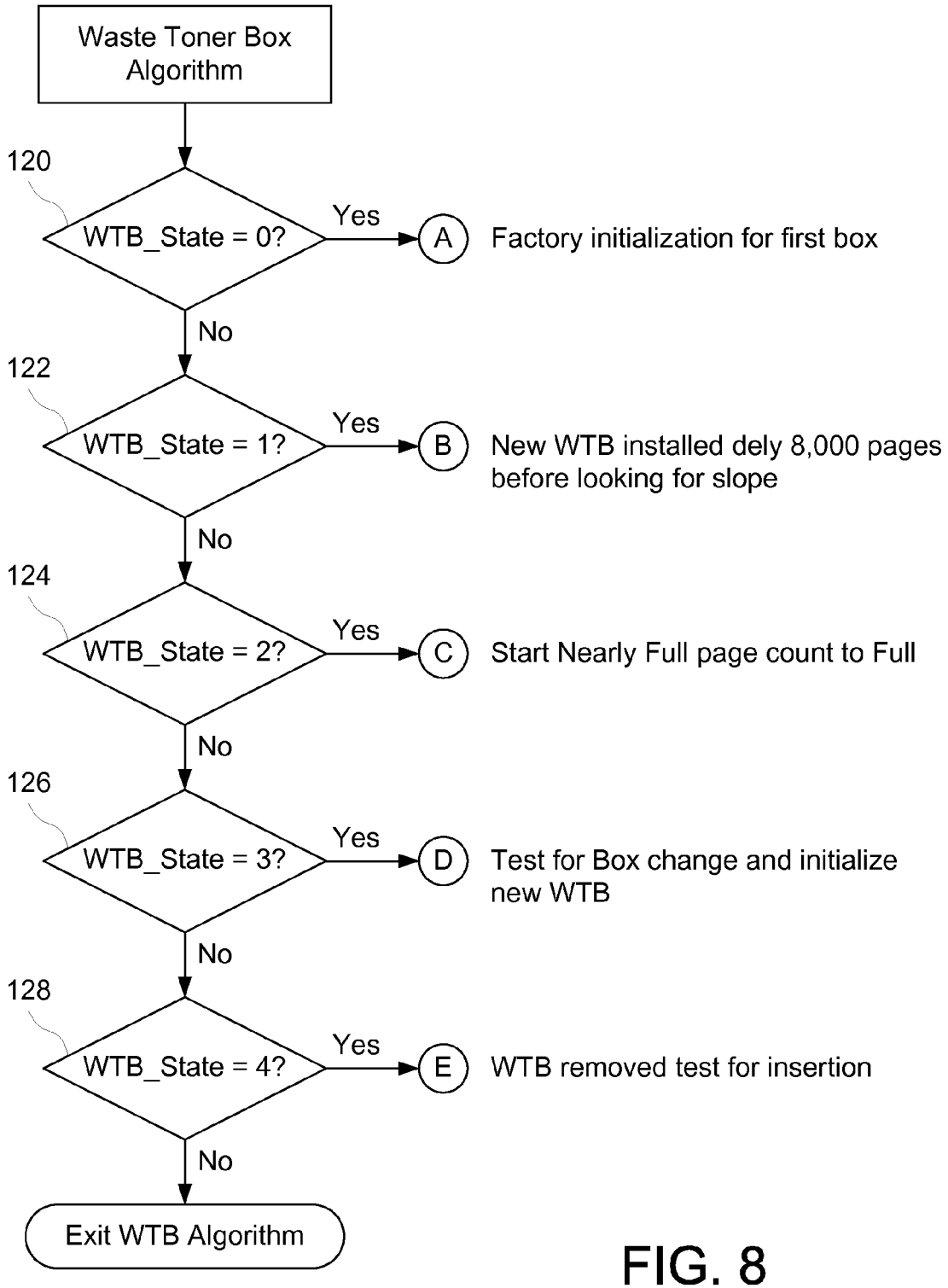
FIG. 8 illustrates processing actions taken to determine the status of a waste toner box, according to one embodiment of the present invention.

FIGS. 8-13 illustrate the particular processing acts of a waste toner box algorithm executed by the controller 76, in accordance with one embodiment of the present invention. FIG. 8 illustrates the five potential states of the waste toner box 56 (WTB_State): WTB_State=0 (act 120) corresponding to first time factory initialization of the waste toner box 56; WTB_State=1 (act 122) corresponding to a new waste toner box; WTB_State=2 (act 124) corresponding to nearly full state of the waste toner box; WTB_State=3 (act 126) corresponding to the state of the waste toner box as full; and WTB_State=4 (act 128) corresponding to the state of the waste toner box as missing from the imaging apparatus 10. As shown in FIG. 8, depending upon the particular state of waste toner box 56, different actions are taken in determining toner level thereof. Controller 76 may execute the processing acts shown in FIGS. 8-13, for example, whenever a voltage reading is taken from A/D converter 82.

Figure 9A:
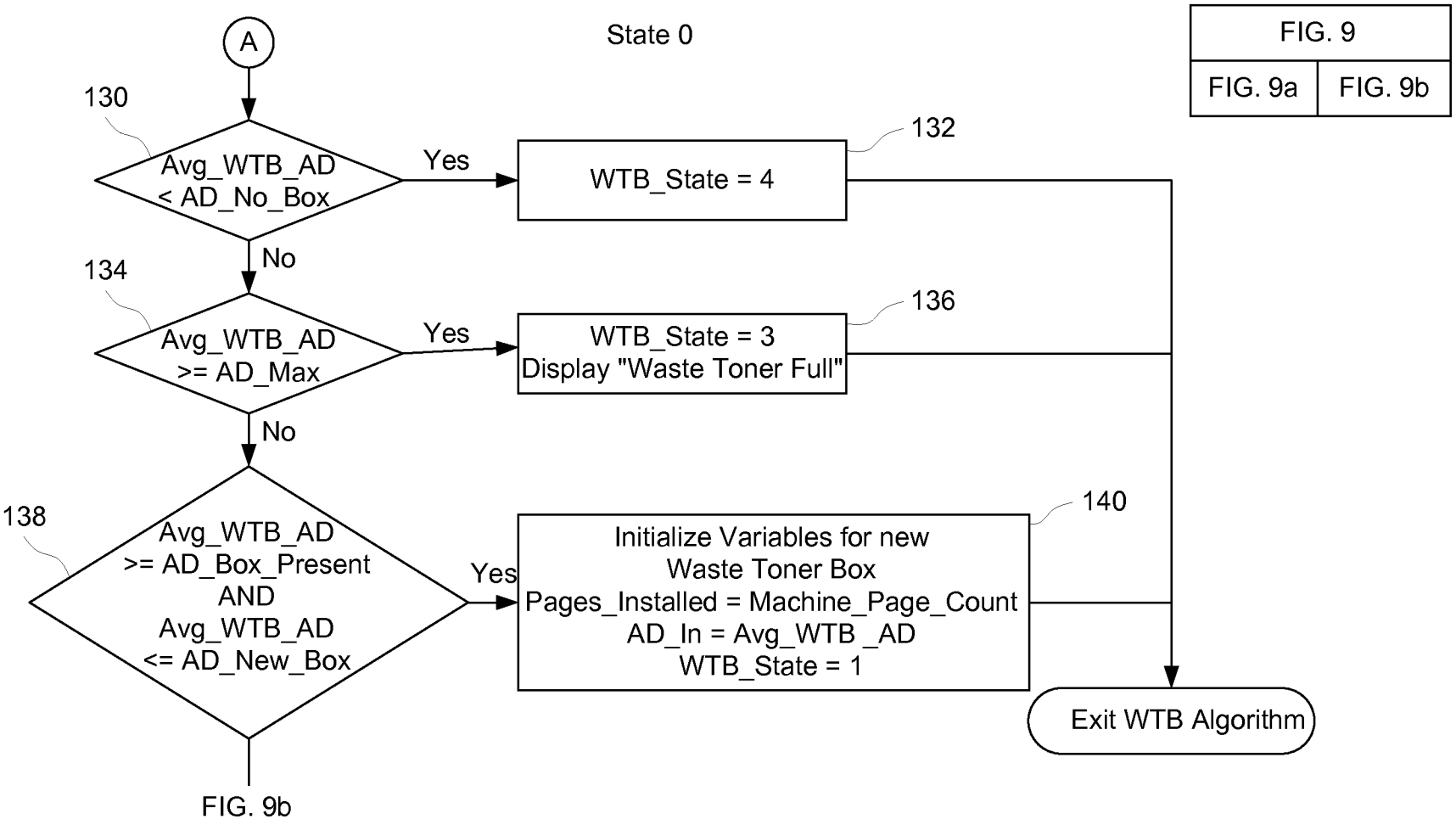
FIGS. 9*a*-9*b* illustrate the processing actions executed by the controller when the waste toner box is initialized for the first time in factory, according to one embodiment of the present invention.
Figure 9B:
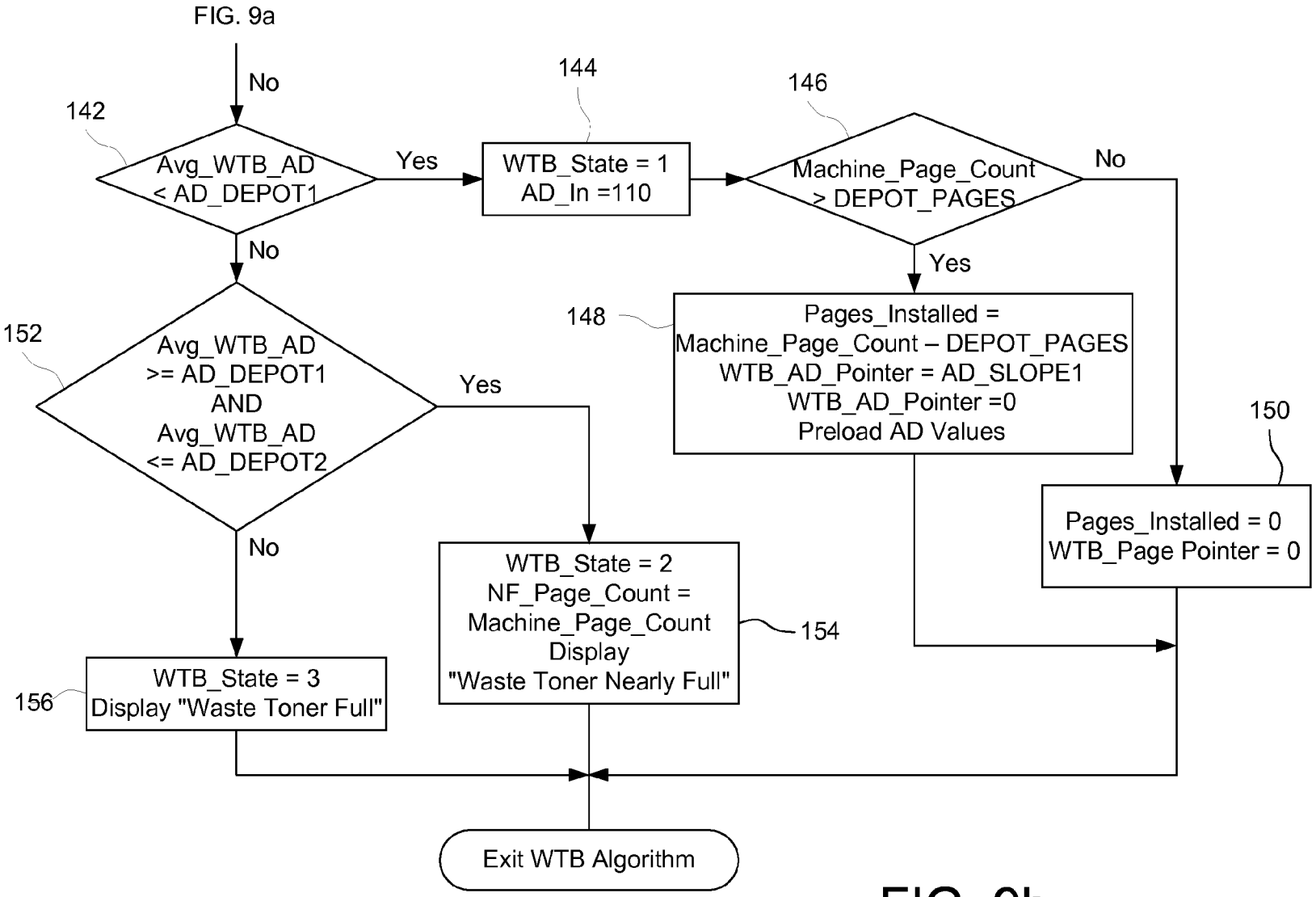

FIGS. 9*a*-9*b* illustrate the processing executed by the controller 76 when the waste toner box 56 was initialized for the first time in the factory (WTB_State=0). The processing of FIGS. 9*a* and 9*b* may also occur, for example, following depot service activity. FIGS. 9*a* and 9*b* show in greater detail the processing described in FIG. 7. Initially, at act 130 it is determined whether the Avg_WTB_AD value is less than the predetermined AD_No_Box voltage value, which is representative of the state of the waste toner box 56 being missing from the imaging apparatus 10. In this embodiment, value AD_NO_BOX may correspond to an output of A/D converter 82 being 25, which is well below output values thereof when waste toner box 56 is present, as shown in FIG. 6. If the condition in act 130 is satisfied, the state of the waste toner box 56 is determined as missing from the imaging apparatus 10 (WTB_State=4) (act 132) and the controller 76 exits the waste toner box algorithm.

In case the Avg_WTB_AD is not less than the value of AD_No_Box, a determination is made whether the value of Avg_WTB_AD is greater than or equal to a predetermined maximum allowed digital voltage value (AD_Max) (act 134). If the condition in act 134 is true, the status of the waste toner box 56 is determined as full (WTB_State=3), the imaging apparatus 10 displays the state of the waste box 56 as full (act 136), and the controller 76 exits the waste toner box algorithm. In one embodiment, the predetermined AD_Max value is 170, which can be seen in FIG. 6 as corresponding to an exceedingly high output voltage from A/D converter 82.

Next, if the value of Avg_WTB_AD is less than the AD_Max value at act 138, a determination is made whether the toner level corresponds to the toner level of a new waste toner box 36. In particular, it is determined whether the value of Avg_WTB_AD is greater than a predetermined AD_Box_Present value, which is representative of the presence of waste toner box in the imaging apparatus 10, and less than a predetermined AD_New_Box voltage value, which is representative of a new waste toner box installed in the imaging apparatus 10. If this determination is true, the state of the waste toner box 56 is set as new (WTB_State=1); the value of AD_IN is set to Avg_WTB_AD wherein AD_IN represents the output of A/D converter 82 when waste toner box 56 is new; the Pages_Installed variable, which represents the page count when a new waste toner box is installed, is set to the value of the Machine_Page_Count variable; and the controller 76 exits the waste toner box algorithm. In one embodiment, the AD_Box_Present value is 75 and the AD_New_Box value is 110, which roughly correspond to the range of output voltages of A/D converter 82 when toner is below the plates of capacitor 66 as seen in FIG. 6.

In case the condition in act 138 is false, a determination is made whether the value of Avg_WTB_AD corresponds to a toner level of a waste toner box just prior to successive measurements of Avg_WTB_AD showing a meaningful change in capacitance of capacitor 66. In particular, it is determined whether value Avg_WTB_AD is less than a predetermined AD_DEPOT1 voltage value, such as 125 (act 142). If this condition is true, the status of the waste toner box is determined as new (WTB_State=1) and the AD_In variable is set to 110 (act 144). Next, in act 146 it is determined whether the Machine_Page_Count value is greater than a DEPOT_PAGES value, which is representative of a threshold depot number of pages printed by the imaging apparatus 10 and in this embodiment may be 8000. In the event the condition in act 146 is false, box status variables and pointers are reset to values corresponding to a new waste toner box: the Pages_Installed variable is set to zero; the WTB_Page_Pointer variable, which tracks the number of voltage readings of A/D converter 82, is also set to zero; and variable WTB_AD_Pointer, which points to one of a set of recent voltage readings of A/D converter 82, is set to zero.

However, if the Machine_Page_Count variable is greater than 8000, such internal variables are set to other values corresponding to a waste toner box having had some amount of use. If the condition in act 146 is true, meaning that imaging apparatus 10 has printed more than 8000 pages, then a difference is calculated between the Machine_Page_Count and the DEPOT_PAGES values, and the Pages_Installed variable is set to the calculated difference value. The WTB_AD_Pointer variable is set to AD_Slope1 value which may be 16 in the present embodiment and corresponds to a number of voltage readings having been performed, and the Avg_WTB_AD values are loaded in an array of A/D converter output readings (act 148).

In case the Avg_WTB_AD value is greater than the AD_DEPOT1 value in act 142, it is determined whether Avg_WTB_AD is less than or equal to a predetermined voltage value AD_DEPOT2 corresponding to toner being at the top of the plates of capacitor 66, such as 150 (act 152). If this condition is true, the status of the waster toner box is determined to be nearly full (WTB_State=2), the variable NF_PAGE_COUNT, which corresponds to the page count of imaging apparatus 10 when waste toner box 56 is nearly full, is set to the Machine_Page_Count value. In addition, the imaging apparatus 10 displays that the waste toner box 56 is nearly full (act 154), and the controller 76 exits the waste toner box algorithm.

In the event the condition in act 152 is not satisfied, meaning that toner level is above capacitor 66, the status of the waste toner box 56 is determined as full (WTB_State=3), the imaging apparatus 10 displays that the waste toner box is full (act 156), and the waste toner box algorithm is exited.

Figure 10A:
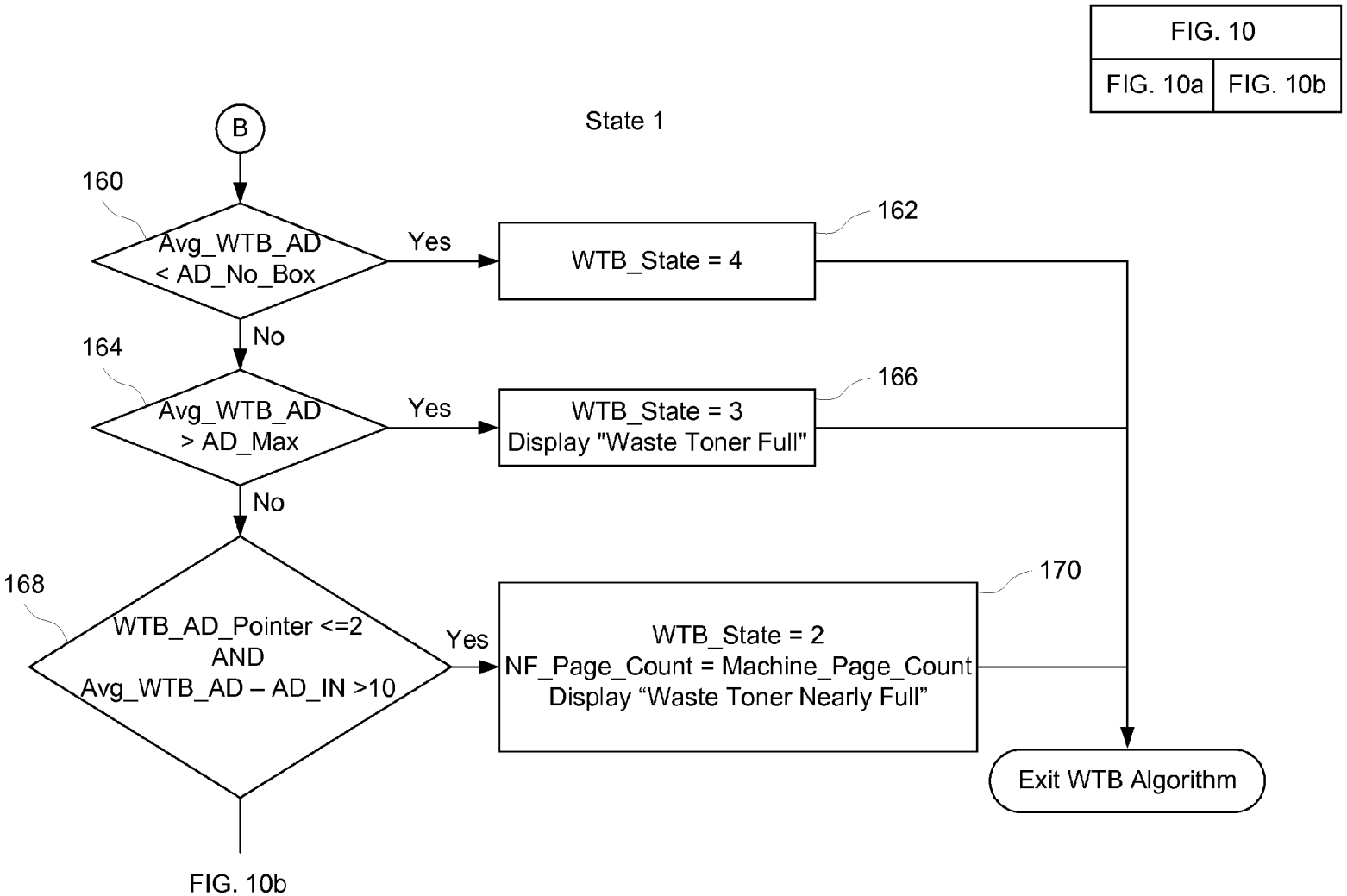
FIGS. 10*a*-10*b* illustrate the processing actions executed by the controller when the state of the waste toner box is new, according to one embodiment of the present invention.
Figure 10B:
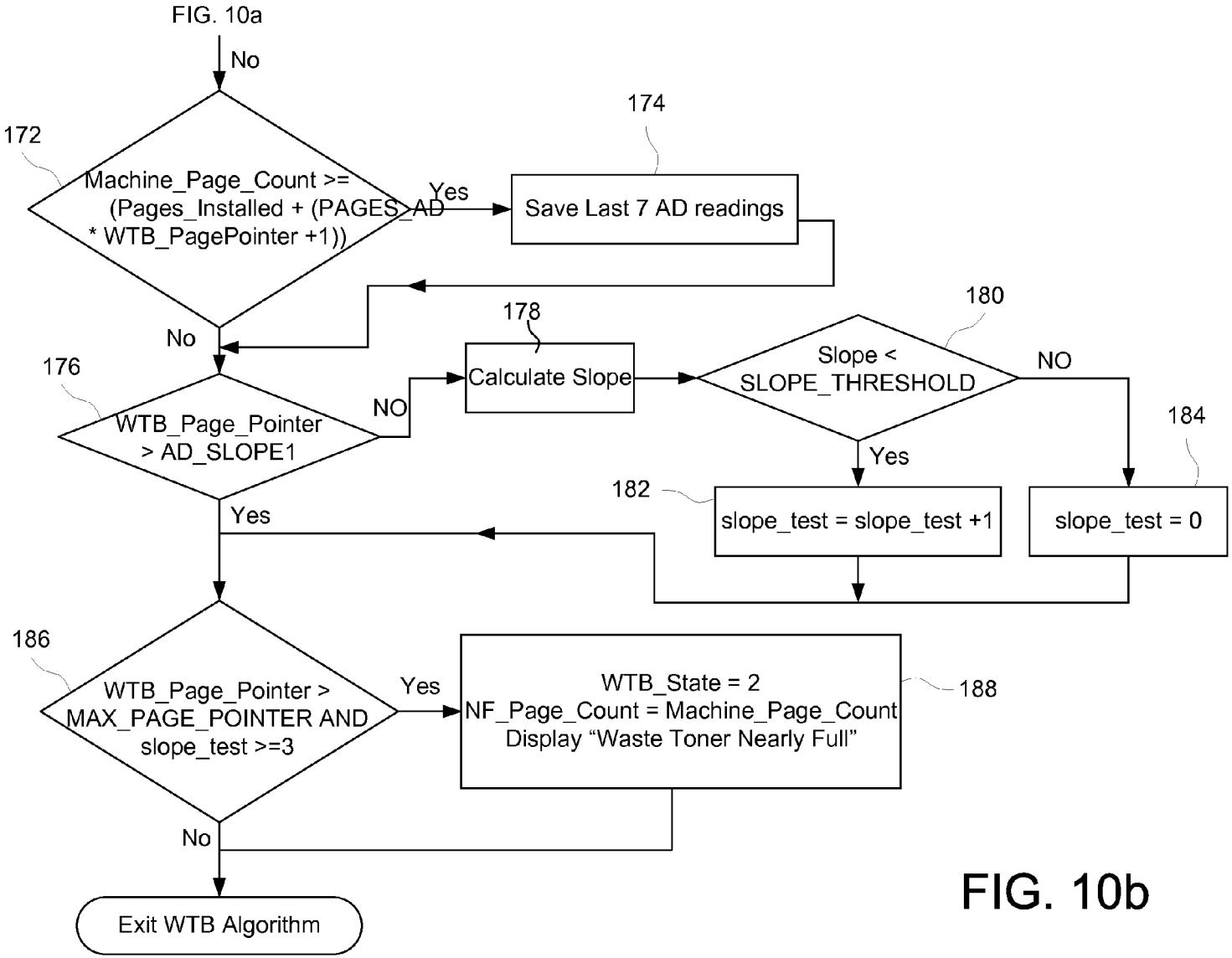

FIGS. 10*a*-10*b* illustrate the processing executed by the controller 76 when the state of the waste toner box 56 is new. Acts 160-166 are largely identical to acts 130-136 in FIG. 9*a*, so such acts will not be described in detail for reasons of simplicity.

If the value Avg_WTB_AD is greater than value AD_No_Box and less than value AD_Max, it is determined whether the variable WTB_AD_Pointer is less than or equal to 2 and whether a difference between the value Avg_WTB_AD and variable AD_In is greater than 10 (act 168). If the condition in act 168 is true, the status of the waste toner box 56 is determined to be nearly full (WTB_State=2), the NF_PAGE_COUNT variable is set to the Machine_Page_Count value, the imaging apparatus 10 displays that the waste toner box 56 is nearly full (act 170), and the controller 76 exits the waste toner box algorithm. Acts 168 and 170 are used as a safety check of sorts to ensure there are no relatively sizeable spikes in successive voltage readings occur while the state of waste toner box 56 is new, and setting the state of waste toner box 56 to be nearly full upon such an occurrence.

If the condition in act 168 is not satisfied, in act 172 it is determined whether the number of pages printed exceeds a threshold amount before the slope of sequential capacitance readings is determined. In particular, it is determined whether the Machine_Page_Count variable is greater than or equal to the sum of variable Pages_Installed and value PAGES_AD multiplied by the sum of WTB_Page Pointer and 1 (act 172), where the value PAGES_AD represents the number of pages printed between A/D converter readings which in this embodiment is 500. If the condition in act 172 is true, a predetermined number of the most recent A/D converter readings are stored in the above-described array, which in this case may be seven (act 174).

In act 176 it is determined whether the WTB_PagePointer variable is greater than the AD_SLOPE1 value, which in this embodiment may be 16. If the event the determination is negative, a slope is calculated by calculating the difference between the voltage readings stored in two consecutive array locations of the array storing values of the Avg_WTB_AD voltage readings and then dividing the difference by the PAGES_AD value (act 178). If this calculated slope is less than a Slope_Threshold value (act 180), which in this case represents a minimum amount of slope, then a slope_test variable is incremented by 1 (act 182). Otherwise, the slope_test variable is set to 0 (act 184). In this way, acts 180-184 maintain a record of successive slope calculations that fall below the Slope_Threshold value.

In act 186 it is determined whether the WTB_Page_Pointer variable is greater than a MAX_PAGE_POINTER value, which in this embodiment may be 40 and represents a maximum number of voltage readings of A/D converter 82, and whether the slope_test variable is greater than or equal to three. In the event the condition in act 186 is true, indicating that a number of Avg_WTB_AD readings have occurred and there have been three readings showing substantially no slope, the status of the waste toner box is determined to be nearly full (WTB_State=2), the NF_Page_Count variable is set to the Machine_Page_Count value, the imaging apparatus 10 displays that the waste toner box is nearly full (act 188), and the controller 76 exits the waste toner box algorithm.

Figure 11:
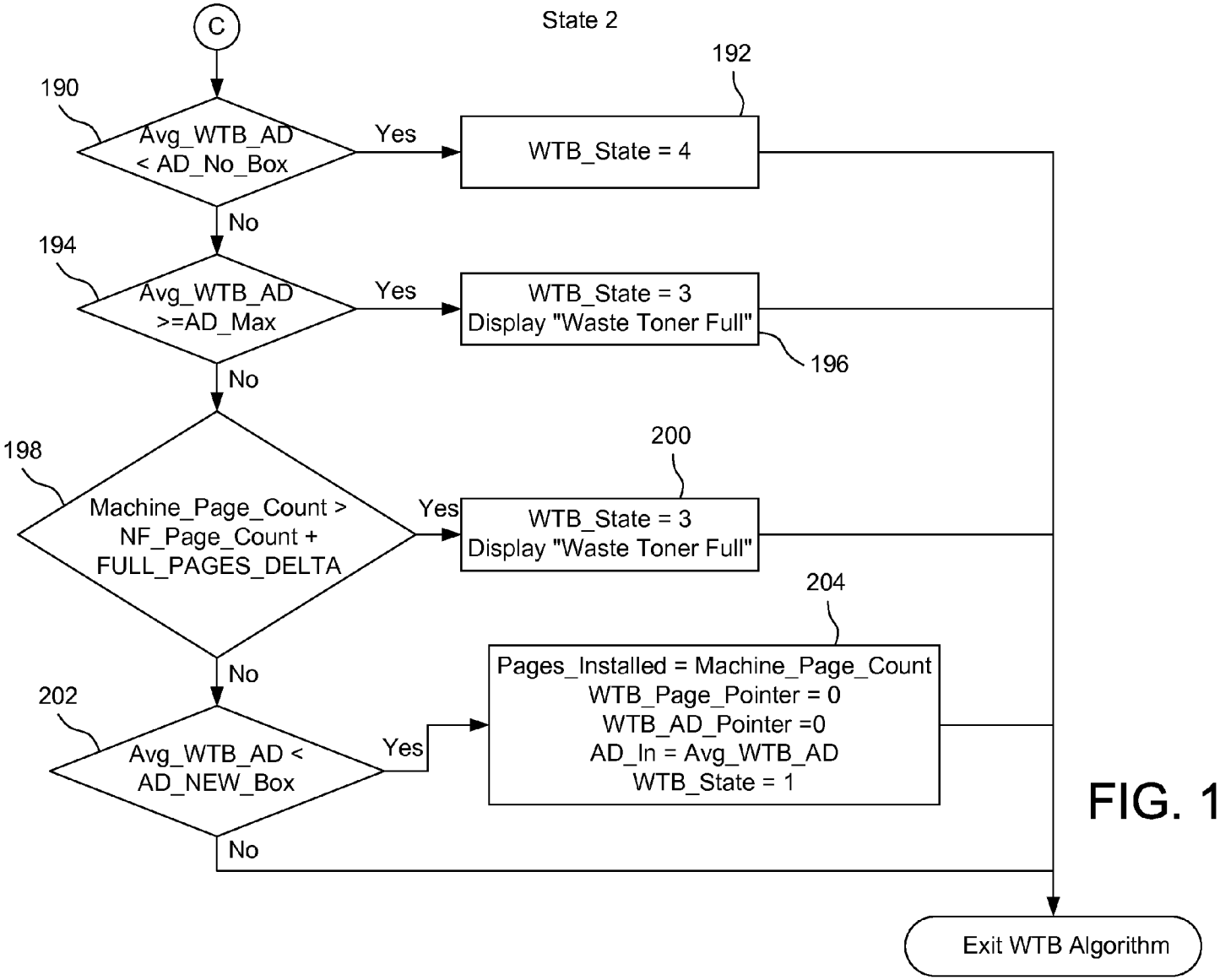
FIG. 11 illustrates the processing actions executed by the controller when the state of the waste toner box is nearly full, according to one embodiment of the present invention.

FIG. 11 illustrates the processing executed by the controller 76 when the state of the waste toner box 56 was determined to be nearly full. Acts 190-196 are largely identical to acts 130-136 of FIG. 9*a* and will not be repeated for reasons of simplicity.

If the Avg_WTB_AD variable is less than the AD_Max value and greater than the AD_NO_Box value, it is determined whether the Machine_Page_Count value is greater than the sum of the NF_Page_Count value and the FULL_PAGES_DELTA value, which in this embodiment may be 2000 (act 198). If this condition (act 198) is satisfied, meaning that imaging apparatus 10 has printed pages numbering a FULL_PAGES_DELTA value since waste toner box 56 was identified as nearly full, the status of the waste toner box 56 is determined as full (WTB_State=3), the imaging apparatus 10 displays the status of the waste box as full (act 200), and the controller 76 exits the waste toner box algorithm.

If the condition in act 198 is not satisfied, thereby indicating that waste toner box 56 is neither missing nor full, it is determined whether the Avg_WTB_AD value is less than the AD_New_Box value (act 202) which in this embodiment may be 110. If the determination of act 202 is true, thereby indicating that the voltage reading of A/D converter 82 corresponds to toner level not yet reaching plates 70 of capacitor 66, the Pages_Installed variable is set to the Machine_Page_Count value, the WTB_Page_Pointer is set to 0, the WTB_AD_Pointer is set to 0, the AD_IN variable is set to Avg_WTB_AD value, the status of the waste toner box 56 is determined as a new waste toner box (WTB_State=1) (act 204), and the controller 76 exits the waste toner box algorithm.

Figure 12:
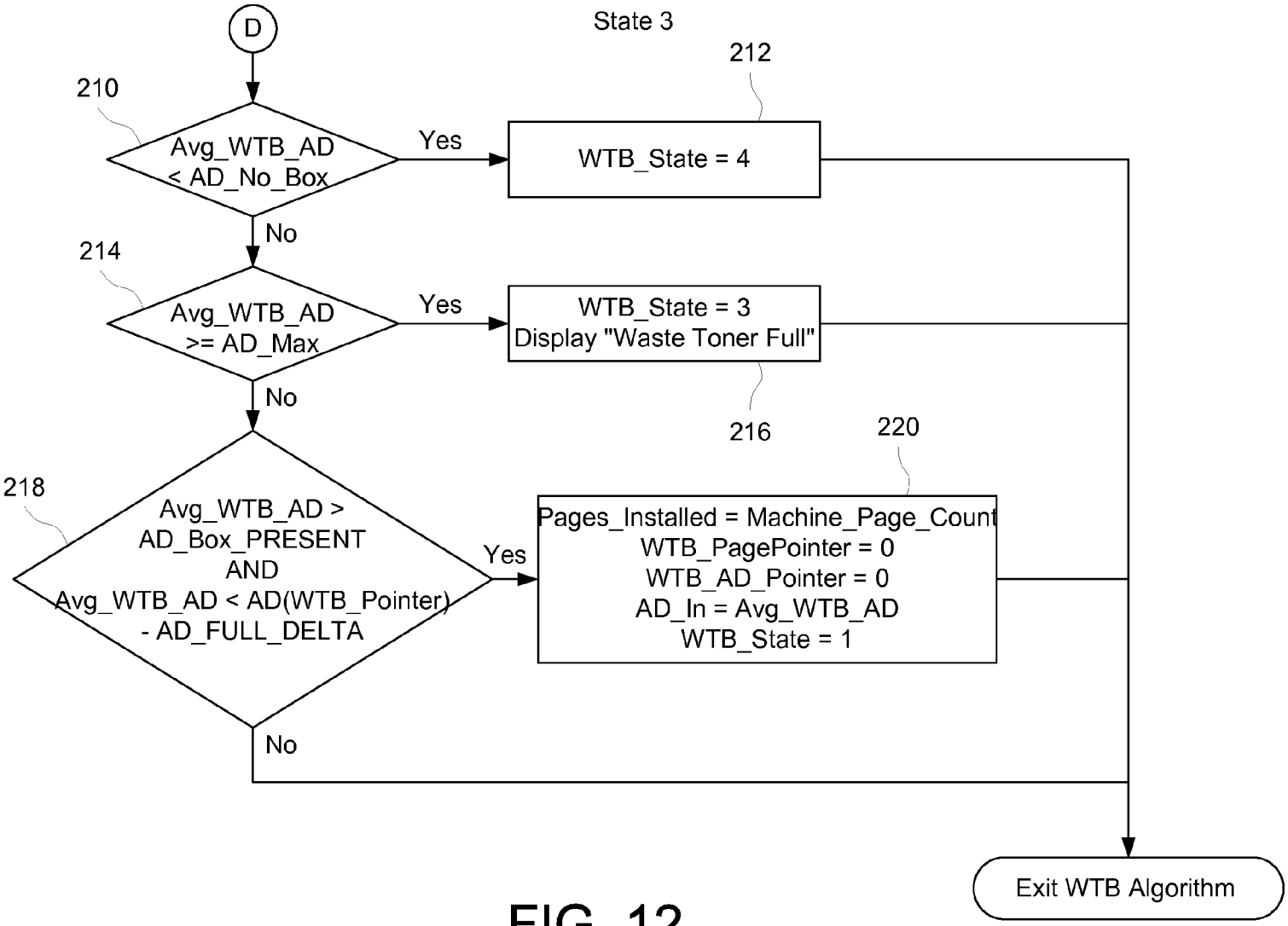
FIG. 12 illustrates the processing actions executed by the controller when the state of the waste toner box is full, according to one embodiment of the present invention.

FIG. 12 illustrates the processing executed by the controller 76 when the state of the waste toner box 56 was determined to be full. Acts 210-216 are mostly identical to acts 130-134 of FIG. 9*a* and will not be described further for reasons of expediency. If the Avg_WTB_AD value is greater than AD_NO_Box and less than AD_Max, it is determined in act 218 whether the Avg_WTB_AD value is greater than the AD_Box_Present value and less than the difference between the value located in the stored array of values of Avg_WTB_AD pointed to by WTB_AD_Pointer and an AD_FULL_DELTA value, which represents a delta value between the voltage values corresponding to new and used waste toner boxes 56 and may be 12 in this embodiment. If the condition in act 218 is satisfied, the status of the waste toner box 56 is determined to be new (WTB_State=1) and variables and pointers are reset accordingly (act 220), after which the controller 76 exits the waste toner box algorithm. For instance, variable WTB_Page_Pointer is set to zero, variable WTB_AD_Pointer is set to zero, and variable AD_In is set to AVG_WTB_AD. If the determination of act 218 is negative, no further action is taken.

Figure 13:
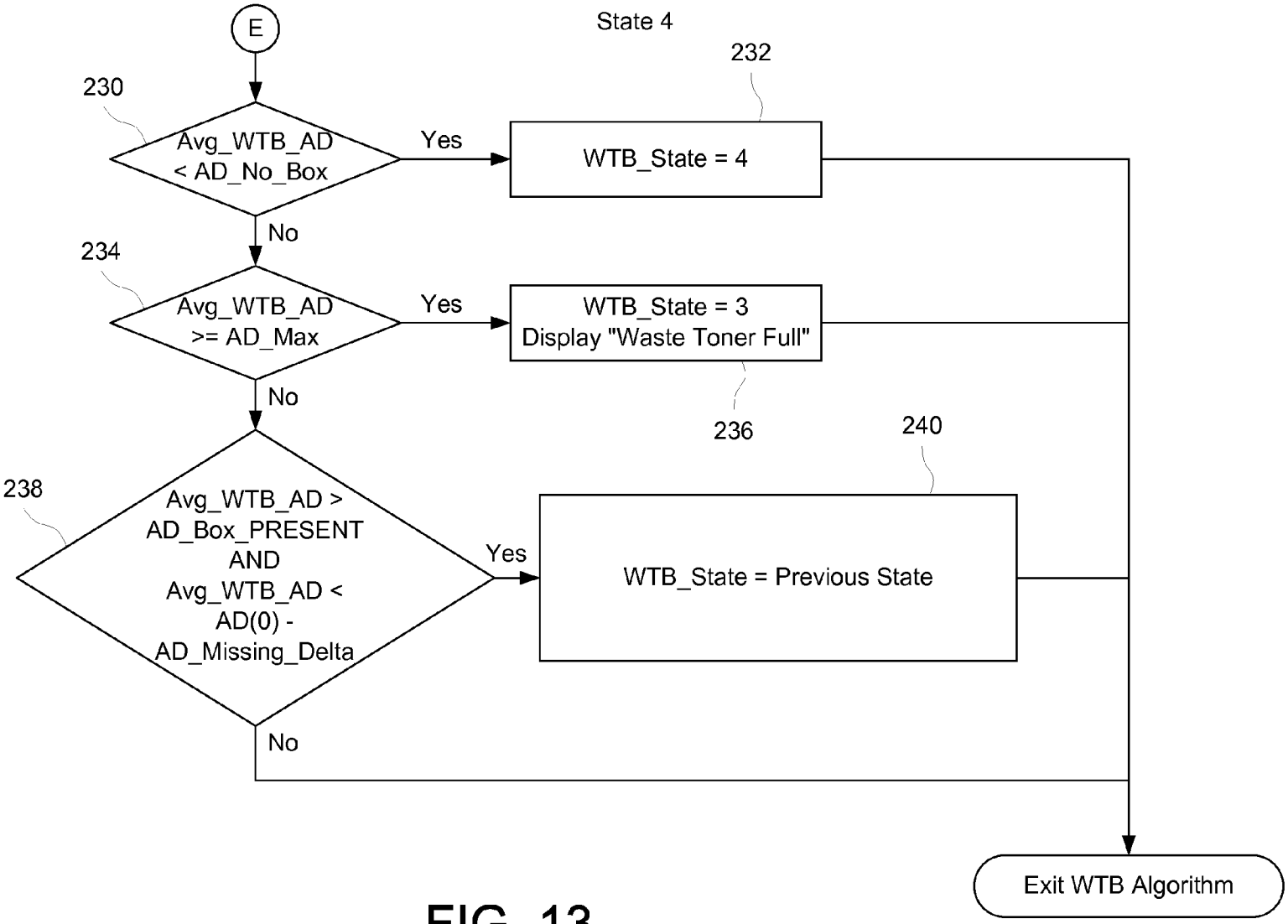
FIG. 13 illustrates the processing actions executed by the controller when the state of the waste toner box is missing from the imaging apparatus, according to one embodiment of the present invention.

FIG. 13 illustrates the processing acts executed by the controller 76 when the state of the waste toner box 56 is that of missing from the imaging apparatus 10. Acts 230-236 are mostly identical to acts 130-134 of FIG. 9*a* and will not be described further for reasons of expediency. If the Avg_WTB_AD is less than the AD_Max value and greater than the AD_NO_Box value, it is determined whether the Avg_WTB_AD value is less than the AD_Box_PRESENT value and whether the AVG_WTB_AD value is less than a difference between the first stored AVG_WTB_AD value in the array and an AD_FULL_DELTA value (act 238), where the AD_MISSING_DELTA value is a delta voltage value between a voltage value with waste toner box 56 in and out of imaging apparatus 10, which in this embodiment may be 12. If the condition in act 238 is true, the state of the waste toner box is placed in its previous state prior to being found missing. Otherwise, no further action is taken.

It is understood that the present invention is not limited to the particular order of processing activity shown in FIGS. 5 and 7-13 such that the present invention contemplates other arrangements of such processing activity. It will be apparent to those skilled in the art that various modifications and variations can be made to the present invention without departing from the spirit and scope of the invention. Thus it is intended that the present invention cover the modifications and variations of this invention provided they come within the scope of the appended claims and their equivalents.

What is claimed is:

1. A method for determining a relative amount of waste toner in a waste toner box of an imaging apparatus comprising:

measuring voltages at a beginning and an end of each of a plurality of intervals, each of the measured voltages corresponding to a capacitance within the waste toner box that varies with an amount of waste toner in between a pair of separated plates;

determining a relative change in capacitance based on the voltages measured, the relative change in capacitance being determined by:

calculating a difference between the voltages measured at the beginning and the end of each of the plurality of intervals; and dividing each voltage difference by a divisor value to determine the relative change in capacitance;

comparing the determined relative change in capacitance with a predetermined threshold value to determine the relative amount of waste toner in the waste toner box;

identifying a first number of pages corresponding to a number of pages printed from a time the waste toner box is empty to a time when the relative amount of waste toner in the waste toner box is initially determined to be nearly full;

identifying a second number of pages corresponding to a number of pages printed from the time the waste toner box is empty to a time after the relative amount of waste toner in the waste toner box is initially determined to be nearly full;

comparing the second number of pages with a sum of the first number of pages and a predetermined full page delta; and when the second number of pages is greater than the sum of the first number of pages and the predetermined full page delta, determining the relative amount of waste toner in the waste toner box as being full.

2. The method according to claim 1, wherein the relative amount of waste toner in the waste toner box is determined as being nearly full when the relative change in capacitance is less than the predetermined threshold value.

3. The method according to claim 1, wherein the divisor value is a predetermined number of pages printed during at least one of the intervals.

4. The method according to claim 1, further comprising delaying the measuring until a predetermined number of pages greater than one thousand have been printed.

5. The method of claim 4, wherein the predetermined number of pages is greater than about four thousand pages.

6. The method of claim 1, wherein the determining the relative change in capacitance based on the voltages measured is performed only after a predetermined number of pages in excess of one page have been printed so that the waste toner has reached the pair of separated plates.

7. The method of claim 1, wherein after the relative amount of waste toner in the waste toner box is determined to be nearly full, determining the relative amount of waste toner to be full without using measured voltages corresponding to capacitances within the waste toner box.

8. An imaging apparatus comprising:

a waste toner box that includes an inlet port for collecting waste toner;

a pair of separated plates positioned within the waste toner box to form a capacitor, the capacitor having a capacitance that varies in correspondence with an amount of waste toner in between the separated plates;

sensor circuitry in electrical communication with the capacitor for measuring voltages at a beginning and an end of each of a plurality of intervals, each of the voltages being indicative of a capacitance of the capacitor; and a controller in electrical communication with the sensor circuitry, the controller determining the amount of waste toner in the waste toner box by:

determining a relative change in capacitance based on the voltages measured, the relative change in capacitance being determined by:

calculating a difference between the voltages measured at the beginning and the end of each of the plurality of intervals; and dividing the difference by a predetermined number to determine the relative change in capacitance, the predetermined number being the number of pages printed during at least one of the plurality of intervals;

comparing the determined relative change in capacitance with a predetermined threshold value, the predetermined threshold value being a substantially negligible value for the relative change in capacitance;

determining the relative amount of waste toner in the waste toner box as being nearly full if the determined relative change in capacitance is less than the predetermined threshold;

setting a first page count to a number of pages printed from when the waste toner box is empty to a time when the waste toner box is initially determined to be nearly full;

comparing a second page count, corresponding to a number of pages printed from when the waste toner box is empty to a time after the waste toner box is determined to be nearly full, with a sum of the first page count and a predetermined full page delta; and determining the relative amount of the waste toner in the waste toner box as being full if the second page count is greater than the sum of the first page count and the predetermined full page delta.

9. The imaging apparatus of claim 8, wherein the sensor circuitry includes:

conditioning electronics that form a resonance circuit with the capacitor, the resonance circuit sensing the change in capacitance as an AC voltage value; and an A/D converter for converting the AC voltage value to a DC voltage value.

10. The imaging apparatus of claim 8, wherein the pair of separated plates are positioned in a middle portion of the waste toner box.

11. The imaging apparatus of claim 8, wherein the controller starts determining the relative change in capacitance only after the waste toner has reached the separated plates.

12. The imaging apparatus of claim 8, wherein the controller starts determining the relative change in capacitance only after a predetermined number of pages greater than four thousand have been printed from a time when the waste toner box is empty.

13. The imaging apparatus of claim 8, wherein the controller, after determining the relative amount of waste toner in the waste toner box as being nearly full, determines the relative amount of waste toner to be full without using feedback from the sensor circuitry.

14. An imaging apparatus comprising:

a waste toner box defining an internal volume for collecting waste toner;

a pair of separated plates positioned in a middle portion of the internal volume, the separated plates forming a capacitor having a capacitance that changes in response to a change in an amount of waste toner existing between the separated plates;

sensor circuitry connected to the capacitor for sensing the capacitance of the capacitor by measuring voltages associated thereto, each of the voltages corresponding to the capacitance of the capacitor at each of a plurality of intervals; and a controller connected to the sensor circuitry and configured to:

determine a relative change in capacitance of the capacitor based on the measured voltages;

comparing the determined relative change in capacitance with a predetermined threshold; and if the determined relative change in capacitance is less than a predetermined threshold, determine that a relative amount of waste toner in the waste toner box is nearly full;

thereafter, without using feedback from the sensor circuitry, determine the relative amount of waste toner as being full by comparing a page count corresponding to a number of pages printed from a time when the waste toner box is initially determined to be nearly full and a predetermined full page delta such that the relative amount of waste toner, after being determined as nearly full, is determined to be full based only on the page count and the predetermined full page delta.

15. The imaging apparatus of claim 14, wherein the controller determines the relative change in capacitance only after a predetermined number of pages greater than four thousand have been printed so that the waste toner has reached the pair of separated plates.

16. The imaging apparatus of claim 14, wherein the controller starts to determine the relative change in capacitance only after the sensor circuitry has measured a predetermined number of voltage readings from a time when the waste toner box is determined to be new, the predetermined number of voltage readings being greater than one thousand.

17. The imaging apparatus of claim 14, wherein the controller starts to determine the relative change in capacitance only after the imaging apparatus has printed a predetermined number of pages greater than one thousand.

18. The imaging apparatus of claim 14, wherein the controller determines that the relative amount of waste toner is full if the second page count is greater than a sum of the first page count and a predetermined full page delta.

* * * * *